US012264667B2

(12) United States Patent
Kabrich et al.

(10) Patent No.: US 12,264,667 B2
(45) Date of Patent: Apr. 1, 2025

(54) CONTROLLING RAMP UP OF A FLUID PUMP

(71) Applicant: Caterpillar Inc., Peoria, IL (US)

(72) Inventors: Todd Ryan Kabrich, Tomball, TX (US); Andy Publes, Katy, TX (US); Mark Francis Grimes, Cypress, TX (US); Yuesheng He, Sugar Land, TX (US)

(73) Assignee: Caterpillar Inc., Peoria, IL (US)

( * ) Notice: Subject to any disclaimer, the term of this patent is extended or adjusted under 35 U.S.C. 154(b) by 285 days.

(21) Appl. No.: 17/649,521

(22) Filed: Jan. 31, 2022

(65) Prior Publication Data

US 2023/0243350 A1 Aug. 3, 2023

(51) Int. Cl.
*F04B 49/08* (2006.01)
*E21B 43/26* (2006.01)
*F04B 51/00* (2006.01)

(52) U.S. Cl.
CPC ..... *F04B 49/08* (2013.01); *E21B 43/2607* (2020.05); *F04B 51/00* (2013.01)

(58) Field of Classification Search
CPC ..... F04B 49/08; F04B 51/11; E21B 43/2607
See application file for complete search history.

(56) References Cited

U.S. PATENT DOCUMENTS 4,602,892 A * 7/1986 Brookstein ..... E21B 17/023 74/502.5
5,941,305 A * 8/1999 Thrasher ..... E21B 43/121 417/18
11,066,915 B1 * 7/2021 Yeung ..... E21B 43/2607
11,067,481 B2 7/2021 Ochring et al.
11,091,992 B2 8/2021 Broussard et al.
11,149,533 B1 * 10/2021 Yeung ..... F04B 15/02
2006/0088423 A1 * 4/2006 Brunet ..... F04B 49/065 417/42
2008/0277637 A1 * 11/2008 Heinrichs ..... B66D 1/225 254/342
2015/0368543 A1 * 12/2015 Shanbhag ..... C04B 26/18 166/295
2019/0111927 A1 * 4/2019 Offerle ..... B60W 30/184
2019/0331117 A1 * 10/2019 Gable ..... F04B 47/04
2019/0338767 A1 * 11/2019 Robison ..... E21B 43/127
2020/0109610 A1 * 4/2020 Husøy ..... F04B 9/1172
2020/0340313 A1 * 10/2020 Fischer ..... H02K 7/18
2020/0370400 A1 * 11/2020 Guindi ..... E21B 47/008
2021/0010332 A1 * 1/2021 Benedict ..... E21B 17/046
(Continued)

FOREIGN PATENT DOCUMENTS

WO 2018161577 A1 9/2018

*Primary Examiner* — Connor J Tremarche

(57) ABSTRACT

In some implementations, a controller may monitor, during a ramp up period of a fluid pump driven by a motor that is controlled by a variable frequency drive (VFD), an intake pressure of the fluid pump and a discharge pressure of the fluid pump. The controller may detect, based on monitoring the intake pressure and the discharge pressure, whether the intake pressure satisfies an intake pressure threshold or the discharge pressure satisfies a discharge pressure threshold. The controller may cause, via the VFD, reduction of a torque of the motor based on the intake pressure satisfying the intake pressure threshold or the discharge pressure satisfying the discharge pressure threshold.

20 Claims, 3 Drawing Sheets

(56) References Cited

U.S. PATENT DOCUMENTS

| | | | | |
|---|---|---|---|---|
| 2021/0054847 | A1 | 2/2021 | Badkoubeh et al. | |
| 2021/0063271 | A1* | 3/2021 | Mazrooee | E21B 43/26 |
| 2021/0301815 | A1* | 9/2021 | Chretien | F04B 51/00 |
| 2021/0404310 | A1* | 12/2021 | Yeung | F04B 15/02 |
| 2022/0113702 | A1* | 4/2022 | Jaaskelainen | E21B 43/16 |

* cited by examiner

CONTROLLING RAMP UP OF A FLUID PUMP

TECHNICAL FIELD

The present disclosure relates generally to hydraulic fracturing systems and, for example, to controlling ramp up of a fluid pump.

BACKGROUND

Hydraulic fracturing is a well stimulation technique that typically involves pumping hydraulic fracturing fluid into a wellbore (e.g., using one or more well stimulation pumps) at a rate and a pressure (e.g., up to 15,000 pounds per square inch) sufficient to form fractures in a rock formation surrounding the wellbore. This well stimulation technique often enhances the natural fracturing of a rock formation to increase the permeability of the rock formation, thereby improving recovery of water, oil, natural gas, and/or other fluids.

To begin hydraulic fracturing operations, one or more fluid pumps of a hydraulic fracturing system may be ramped up (e.g., gradually increased in flow rate) until a target flow rate is reached. During this ramp up period, an irregularity in the hydraulic fracturing system, such as a leak, a clog, an obstruction, or the like, may cause abnormal operation of the fluid pump. Accordingly, excessive wear or damage to a fluid pump may result from the abnormal operation. Moreover, manual inspection of the hydraulic fracturing system is inefficient and time consuming, such that the irregularity may not be discovered in time to prevent damage to the fluid pump.

The control system of the present disclosure solves one or more of the problems set forth above and/or other problems in the art.

SUMMARY

In some implementations, a system for hydraulic fracturing includes a fluid pump; a motor configured to drive the fluid pump; a variable frequency drive (VFD) configured to control the motor; and a controller configured to: monitor, during a ramp up period of the fluid pump, an intake pressure of the fluid pump, a discharge pressure of the fluid pump, and a torque of the motor; detect, based on monitoring the intake pressure, the discharge pressure, and the torque, whether: the intake pressure satisfies an intake pressure threshold, the discharge pressure satisfies a discharge pressure threshold, or the torque corresponds to a maximum torque that is based on a setting for a maximum discharge pressure associated with the fluid pump; and cause, via the VFD, reduction of the torque of the motor based on at least one of the intake pressure satisfying the intake pressure threshold, the discharge pressure satisfying the discharge pressure threshold, or the torque corresponding to the maximum torque.

In some implementations, a method includes monitoring, during a ramp up period of a fluid pump driven by a motor that is controlled by a VFD, an intake pressure of the fluid pump and a discharge pressure of the fluid pump; detecting, based on monitoring the intake pressure and the discharge pressure, whether the intake pressure satisfies an intake pressure threshold or the discharge pressure satisfies a discharge pressure threshold; and causing, via the VFD, reduction of a torque of the motor based on the intake pressure satisfying the intake pressure threshold or the discharge pressure satisfying the discharge pressure threshold.

In some implementations, a controller includes one or more memories, and one or more processors configured to: detect, during a ramp up period of a fluid pump driven by a motor that is controlled by a VFD, that an intake pressure of the fluid pump satisfies an intake pressure threshold, a discharge pressure of the fluid pump satisfies a discharge pressure threshold, or a torque of the motor corresponds to a maximum torque; and cause, via the VFD, reduction of the torque of the motor based on the intake pressure satisfying the intake pressure threshold, the discharge pressure satisfying the discharge pressure threshold, or the torque of the motor corresponding to the maximum torque.

DETAILED DESCRIPTION

Figure 1:
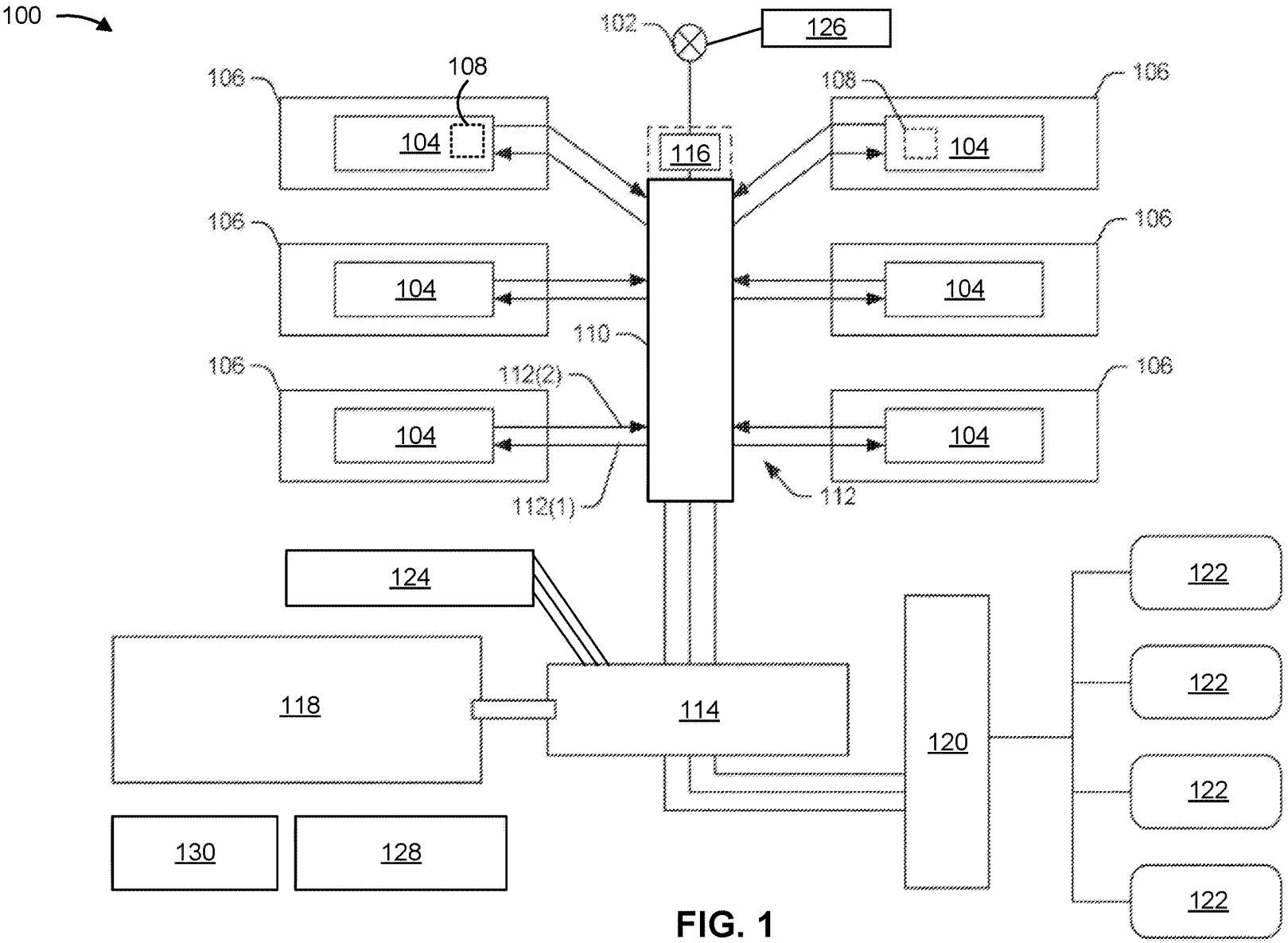
FIG. 1 is a diagram illustrating an example hydraulic fracturing system.

FIG. 1 is a diagram illustrating an example hydraulic fracturing system 100. For example, FIG. 1 depicts a plan view of an example hydraulic fracturing site along with equipment that is used during a hydraulic fracturing process. In some examples, less equipment, additional equipment, or alternative equipment to the example equipment depicted in FIG. 1 may be used to conduct the hydraulic fracturing process.

The hydraulic fracturing system 100 includes a well 102. As described previously, hydraulic fracturing is a well-stimulation technique that uses high-pressure injection of fracturing fluid into the well 102 and corresponding wellbore in order to hydraulically fracture a rock formation surrounding the wellbore. While the description provided herein describes hydraulic fracturing in the context of wellbore stimulation for oil and gas production, the description herein is also applicable to other uses of hydraulic fracturing.

High-pressure injection of the fracturing fluid may be achieved by one or more pump systems 104 that may be mounted (or housed) on one or more hydraulic fracturing trailers 106 (which also may be referred to as "hydraulic fracturing rigs") of the hydraulic fracturing system 100. Each of the pump systems 104 includes at least one fluid pump 108 (referred to herein collectively, as "fluid pumps 108" and individually as "a fluid pump 108"). The fluid pumps 108 may be hydraulic fracturing pumps. The fluid pumps 108 may include various types of high-volume hydraulic fracturing pumps such as triplex or quintuplex pumps. Additionally, or alternatively, the fluid pumps 108 may include other types of reciprocating positive-displacement pumps or gear pumps. A type and/or a configuration of the fluid pumps 108 may vary depending on the fracture gradient of the rock formation that will be hydraulically fractured, the quantity of fluid pumps 108 used in the hydraulic fracturing system 100, the flow rate necessary to complete the hydraulic fracture, the pressure necessary to complete the hydraulic fracture, or the like. The hydraulic fracturing system 100 may include any number of trailers 106 having fluid pumps 108 thereon in order to pump hydraulic fracturing fluid at a predetermined rate and pressure.

In some examples, the fluid pumps 108 may be in fluid communication with a manifold 110 via various fluid conduits 112, such as flow lines, pipes, or other types of fluid conduits. The manifold 110 combines fracturing fluid received from the fluid pumps 108 prior to injecting the fracturing fluid into the well 102. The manifold 110 also distributes fracturing fluid to the fluid pumps 108 that the manifold 110 receives from a blender 114 of the hydraulic fracturing system 100. In some examples, the various fluids are transferred between the various components of the hydraulic fracturing system 100 via the fluid conduits 112. The fluid conduits 112 include low-pressure fluid conduits 112(1) and high-pressure fluid conduits 112(2). In some examples, the low-pressure fluid conduits 112(1) deliver fracturing fluid from the manifold 110 to the fluid pumps 108, and the high-pressure fluid conduits 112(2) transfer high-pressure fracturing fluid from the fluid pumps 108 to the manifold 110.

The manifold 110 also includes a fracturing head 116. The fracturing head 116 may be included on a same support structure as the manifold 110. The fracturing head 116 receives fracturing fluid from the manifold 110 and delivers the fracturing fluid to the well 102 (via a well head mounted on the well 102) during a hydraulic fracturing process. In some examples, the fracturing head 116 may be fluidly connected to multiple wells. The fluid pumps 108, the fluid conduits 112, the manifold 110, and/or the fracturing head 116 may define a fluid system of the hydraulic fracturing system 100. As described herein, a pressure test of the fluid system may be conducted to test an integrity of the fluid system.

The blender 114 combines proppant received from a proppant storage unit 118 with fluid received from a hydration unit 120 of the hydraulic fracturing system 100. In some examples, the proppant storage unit 118 may include a dump truck, a truck with a trailer, one or more silos, or other type of containers. The hydration unit 120 receives water from one or more water tanks 122. In some examples, the hydraulic fracturing system 100 may receive water from water pits, water trucks, water lines, and/or any other suitable source of water. The hydration unit 120 may include one or more tanks, pumps, gates, or the like.

The hydration unit 120 may add fluid additives, such as polymers or other chemical additives, to the water. Such additives may increase the viscosity of the fracturing fluid prior to mixing the fluid with proppant in the blender 114. The additives may also modify a pH of the fracturing fluid to an appropriate level for injection into a targeted formation surrounding the wellbore. Additionally, or alternatively, the hydraulic fracturing system 100 may include one or more fluid additive storage units 124 that store fluid additives. The fluid additive storage unit 124 may be in fluid communication with the hydration unit 120 and/or the blender 114 to add fluid additives to the fracturing fluid.

In some examples, the hydraulic fracturing system 100 may include a balancing pump 126. The balancing pump 126 provides balancing of a differential pressure in an annulus of the well 102. The hydraulic fracturing system 100 may include a data monitoring system 128. The data monitoring system 128 may manage and/or monitor the hydraulic fracturing process performed by the hydraulic fracturing system 100 and the equipment used in the process. In some examples, the management and/or monitoring operations may be performed from multiple locations. The data monitoring system 128 may be supported on a van, a truck, or may be otherwise mobile. The data monitoring system 128 may include a display for displaying data for monitoring performance and/or optimizing operation of the hydraulic fracturing system 100. In some examples, the data gathered by the data monitoring system 128 may be sent off-board or off-site for monitoring performance and/or performing calculations relative to the hydraulic fracturing system 100.

The hydraulic fracturing system 100 includes a controller 130. The controller 130 is in communication (e.g., by a wired connection or a wireless connection) with the pump systems 104 of the trailers 106. The controller 130 may also be in communication with other equipment and/or systems of the hydraulic fracturing system 100. The controller 130 may include one or more memories, one or more processors, and/or one or more communication components. The controller 130 (e.g., the one or more processors) may be configured to perform operations associated with controlling a ramp up of the fluid pumps 108, as described in connection with FIG. 2.

As indicated above, FIG. 1 is provided as an example. Other examples may differ from what is described with regard to FIG. 1.

Figure 2:
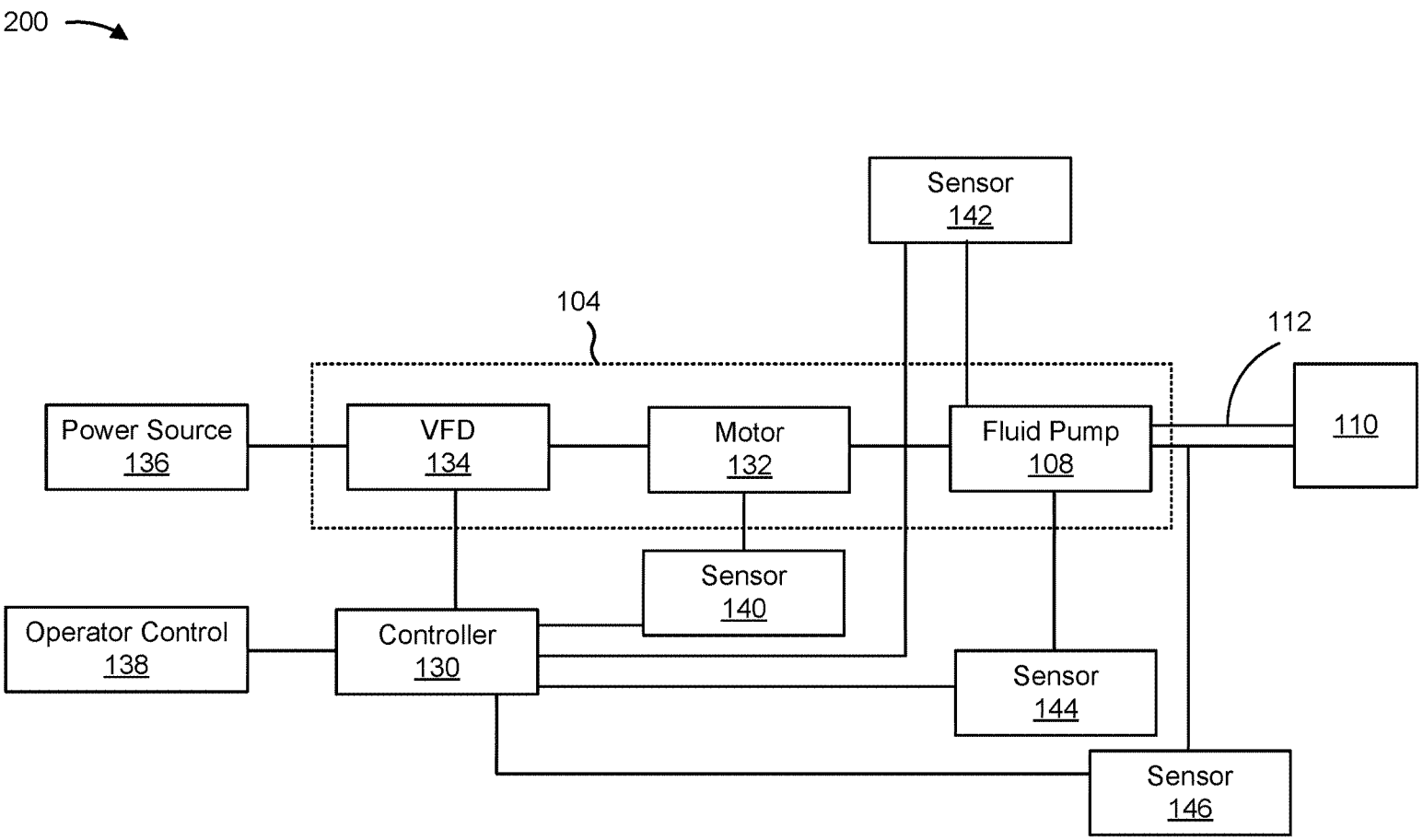
FIG. 2 is a diagram illustrating an example control system.

FIG. 2 is a diagram illustrating an example control system 200. The control system 200 may include one or more components of the hydraulic fracturing system 100, as described herein.

As shown in FIG. 2, the control system 200 includes a pump system 104, and the pump system 104 includes a fluid pump 108, as described herein. The pump system 104 also includes a motor 132 configured to drive (e.g., via a driveshaft) the fluid pump 108. The motor 132 may include an electric motor (e.g., an alternating current (AC) electric motor), such as an induction motor or a switched reluctance motor. In some examples, the fluid pump 108 and the motor 132 may share a housing. The pump system 104 also includes a variable frequency drive (VFD) 134 that controls the motor 132. For example, the VFD 134 includes an electro-mechanical drive system configured to control a speed and/or a torque of the motor 132 by varying an input frequency and/or input voltage to the motor 132. The pump system 104 may receive electrical power from a power source 136. For example, the power source 136 may be a generator, a generator set, a battery, one or more solar panels, an electrical utility grid, an electrical microgrid, or the like.

As shown in FIG. 2, the control system 200 includes at least one fluid conduit 112 and/or the manifold 110, as described herein. The fluid conduit(s) 112 may be in fluid communication with the fluid pump 108. For example, the fluid conduit(s) 112 may fluidly connect the fluid pump 108 and the manifold 110, the manifold 110 and the well 102 (e.g., via the fracturing head 116), or the like. In other words, the fluid conduit(s) 112 may fluidly connect components of the hydraulic fracturing system 100 that are downstream of the manifold 110 and/or the fluid pump 108.

As shown in FIG. 2, the control system 200 includes the controller 130. The controller 130 may be configured to perform operations associated with controlling ramp up of the fluid pump 108, as described herein. "Ramp up" of the fluid pump 108 may refer to gradually increasing a flow rate of the fluid pump 108. The controller 130 may be a component of the VFD 134, or the controller 130 may be a component separate from the VFD 134. For example, the controller 130 may be a pump-specific controller for the pump system 104, or the controller 130 may be a system-wide controller for the hydraulic fracturing system 100.

The controller 130 may obtain a setting for a maximum discharge pressure associated with the fluid pump 108. For example, the setting for the maximum discharge pressure may indicate a maximum discharge pressure for the fluid pump 108 or a maximum discharge pressure of a fluid system that includes the fluid pump 108 and at least one additional fluid pump (e.g., where fluid flows of the fluid pumps are combined at the manifold 110). The maximum discharge pressure may represent a discharge pressure that is adequate, safe, or otherwise prescribed for use during a hydraulic fracturing operation on a particular rock formation. For example, the maximum discharge pressure may be a peak discharge pressure that is to be allowed during a hydraulic fracturing operation (e.g., during operation of the hydraulic fracturing system 100 and/or the control system 200).

In some implementations, the controller 130 may obtain the setting for the maximum discharge pressure from a local or a remote memory or other storage, from another device, or the like. For example, the setting for the maximum discharge pressure may be configured for the controller 130. Additionally, or alternatively, to obtain the setting for the maximum discharge pressure, the controller 130 may receive an input (e.g., an operator input) that indicates the setting for the maximum discharge pressure. For example, the controller 130 may receive the input from an operator control 138 (e.g., a human-machine interface). The operator control 138 may be located at the data monitoring system 128, elsewhere at a hydraulic fracturing site, or remote from the hydraulic fracturing site.

The controller 130 may determine a maximum torque for the motor 132 that achieves the maximum discharge pressure (e.g., achieves the maximum discharge pressure for the fluid pump 108 or for the fluid system that includes the fluid pump 108 and at least one additional fluid pump). The controller 130 may determine the maximum torque for the motor 132, that achieves the maximum discharge pressure, based on a configuration of the pump system 104 (or a configuration of the hydraulic fracturing system 100, the control system 200, or the like). The configuration of the pump system 104 may include a gear ratio of the fluid pump 108 and/or the motor 132, a stroke length of the fluid pump 108, a bore diameter (e.g., a plunger diameter) of the fluid pump 108, and/or a parasitic loss associated with the fluid pump 108, among other examples. In some implementations, the controller 130 may determine the maximum torque for the motor 132, that achieves the maximum discharge pressure, using a look-up table, a torque curve, a physics-based estimation model, an artificial intelligence model (e.g., a machine learning model), or the like (e.g., that is based on the configuration of the pump system 104, an age of the pump system 104, or the like).

The controller 130 may obtain a setting for a flow rate associated with the fluid pump 108. For example, the setting for the flow rate may indicate a flow rate for the fluid pump 108 or a flow rate of the fluid system that includes the fluid pump 108 and at least one additional fluid pump (e.g., where fluid flows of the fluid pumps are combined at the manifold 110). The setting for the flow rate may indicate a commanded flow rate for the fluid pump 108. In some implementations, the controller 130 may obtain the setting for the flow rate from a local or a remote memory or other storage, from another device, or the like, in a similar manner as described above. Additionally, or alternatively, to obtain the setting for the flow rate, the controller 130 may receive an input (e.g., an operator input) that indicates the setting for the flow rate, in a similar manner as described above. The controller 130 obtaining the setting for the flow rate may trigger a ramp up of the fluid pump 108. In some examples (e.g., based on obtaining the setting for the flow rate), the controller 130 may indicate, to the VFD 134, a speed for the motor 132 and/or a rate of speed increase for the motor 132 that is based on the setting for the flow rate.

The controller 130 may determine an estimated actual torque of the motor 132 and/or be configured to obtain a measurement of the actual torque of the motor 132. The controller 130 may determine the estimated torque of the motor 132 based on a magnetic flux of the motor 132 and/or a current of an armature of the motor 132. The controller 130 may obtain the measurement of the torque of the motor 132 from a sensor 140 (e.g., a torque transducer) configured to detect the torque of the motor 132. The sensor 140 may be located at an output shaft of the motor 132.

The controller 130 may obtain a measurement relating to an intake pressure (e.g., a suction pressure, an inlet pressure, a low pressure, or the like) of the fluid pump 108. For example, the controller 130 may obtain the measurement relating to the intake pressure from a sensor 142 (e.g., a pressure sensor) configured to detect the intake pressure of the fluid pump 108. The sensor 142 may be located at an inlet of the fluid pump 108, in a fluid conduit in fluid communication with the inlet of the fluid pump 108, or the like.

The controller 130 may obtain a measurement relating to a discharge pressure (e.g., an outlet pressure, a high pressure, or the like) of the fluid pump 108. For example, the controller 130 may obtain the measurement relating to the discharge pressure from a sensor 144 (e.g., a pressure sensor) configured to detect the discharge pressure of the fluid pump 108. The sensor 144 may be located at an outlet of the fluid pump 108, in the fluid conduit 112 in fluid communication with the outlet of the fluid pump 108, in the manifold 110, or the like.

In some implementations, the controller 130 may obtain a measurement relating to a flow rate associated with the fluid pump 108 (e.g., a flow rate of the fluid pump 108 or a flow rate of the fluid system that includes the fluid pump 108 and at least one additional fluid pump). For example, the controller 130 may obtain the measurement relating to the flow rate from a sensor 146 (e.g., a flow meter) configured to detect the flow rate associated with the fluid pump 108. The sensor 146 may be located at an outlet of the fluid pump 108, in the fluid conduit 112 in fluid communication with the outlet of the fluid pump 108, in the manifold 110, or the like.

The controller 130 may monitor the intake pressure of the fluid pump 108, the discharge pressure of the fluid pump 108, the torque of the motor 132, and/or the flow rate associated with the fluid pump 108. For example, the controller 130 may monitor the intake pressure, the discharge pressure, the torque, and/or the flow rate during a ramp up period of the fluid pump 108 (e.g., a ramp up period of the fluid system that includes the fluid pump 108 and at least one additional fluid pump). "Ramp up period" may refer to a period of time in which the fluid pump 108 is increasing flow rate from a lower flow rate (e.g., 0 gallons per minute or barrels per minute) to a higher flow rate (e.g., a commanded flow rate, a target flow rate, a maximum flow rate, or the like). As described herein, the ramp up period of the fluid pump 108 may be initiated when the controller 130 obtains the commanded flow rate for the fluid pump 108.

To monitor the intake pressure, the discharge pressure, the torque, and/or the flow rate, the controller 130 may determine the estimated torque, obtain the measurement of the actual torque, obtain the measurement of the intake pressure, obtain the measurement of the discharge pressure, and/or obtain the measurement of the flow rate, as described herein, at one or more time points (e.g., periodically, aperiodically, or the like). Moreover, to monitor the intake pressure, the discharge pressure, the torque, and/or the flow rate, the controller 130 may compare the torque (e.g., the estimated torque or the actual torque) to the maximum torque, compare the intake pressure to an intake pressure threshold, compare the discharge pressure to a discharge pressure threshold, and/or compare the flow rate to the commanded flow rate.

The controller 130 may detect whether the torque corresponds to (e.g., is equal to, exceeds, or the like) the maximum torque, whether the intake pressure satisfies (e.g., is equal to or less than) the intake pressure threshold, whether the discharge pressure satisfies (e.g., is equal to or greater than) the discharge pressure threshold, and/or whether the flow rate is less than the commanded flow rate. The controller 130 may detect one or more of the aforementioned conditions based on monitoring the intake pressure, the discharge pressure, the torque, and/or the flow rate. For example, the controller 130 may detect one or more of the aforementioned conditions during the ramp up period.

Detection of one or more of the aforementioned conditions by the controller 130 may indicate an irregularity of the pump system 104 and/or the hydraulic fracturing system 100. For example, the intake pressure being less than the intake pressure threshold may indicate a leak at, or upstream of, the inlet of the fluid pump 108. As another example, the discharge pressure being greater than the discharge pressure threshold may indicate a clog at, or downstream of, the outlet of the fluid pump 108.

In some implementations, the discharge pressure threshold may be based on the setting for the maximum discharge pressure (e.g., the discharge pressure threshold may equal the maximum discharge pressure, may be within a tolerance of the maximum discharge pressure, and/or may be a proportion of the maximum discharge pressure). In some implementations, detecting whether the discharge pressure satisfies the discharge pressure threshold and/or detecting whether the flow rate is less than the commanded flow rate may be dependent upon whether the torque satisfies the maximum torque.

For example, if the torque does not correspond to the maximum torque (e.g., the torque is less than the maximum torque), then the controller 130 may detect whether the discharge pressure satisfies the discharge pressure threshold. Otherwise, if the torque corresponds to the maximum torque, then detection of whether the discharge pressure satisfies the discharge pressure threshold may be unnecessary. As another example, if the torque does not correspond to the maximum torque, then the controller 130 may detect whether the flow rate is less than the commanded flow rate. As a further example, if the torque does not correspond to the maximum torque, then the controller 130 may detect whether the flow rate is less than a first commanded flow rate set point, and if the torque corresponds to the maximum torque, then the controller 130 may detect whether the flow rate is less than a second commanded flow rate set point. Here, detecting that the flow rate is less than the first commanded flow rate set point may indicate a potential for an irregularity (e.g., there is not yet a need to restrain the fluid pump 108), whereas detecting that the flow rate is less than the second commanded flow rate set point may indicate an irregularity.

The controller 130 may cause reduction to the torque of the motor 132. For example, the controller 130 may cause reduction to the torque of the motor 132 if an irregularity of the pump system 104 and/or the hydraulic fracturing system 100 is detected. That is, the controller 130 may cause reduction to the torque of the motor 132 based on the torque corresponding to the maximum torque, the intake pressure satisfying the intake pressure threshold, the discharge pressure satisfying the discharge pressure threshold, and/or the flow rate being less than the commanded flow rate. In some implementations, the controller 130 may cause reduction to the torque of the motor 132 based on the intake pressure satisfying (e.g., being less than) the intake pressure threshold for a first threshold time period and/or the discharge pressure satisfying (e.g., being greater than) the discharge pressure threshold for a second threshold time period (where the second threshold time period is the same as, or is different from, the first threshold time period).

The controller 130 may cause reduction of the torque of the motor 132 to zero (e.g., the controller 130 may cause the motor 132 to stop). To cause reduction of the torque of the motor 132, the controller 130 may cause adjustment to a speed of the motor 132 (e.g., the speed of the motor 132 may be adjusted to zero). In this way, in response to a detected irregularity or failure, the fluid pump 108 may be controlled (e.g., shut down or restrained) to reduce or prevent damage to the fluid pump 108. When adjusting the speed of the motor 132, the controller 130 may control a rate of change of the speed of the motor 132 for improved stabilization.

The controller 130 may cause reduction to the torque of the motor 132 via the VFD 134 (e.g., by communicating with a motor control processing unit of the VFD 134). For example, the controller 130 may set a torque setting (e.g., a torque target setting or a torque limit setting), in a control mode (e.g., a torque control mode or a speed control mode) for the VFD 134, to a reduced torque value (e.g., zero, or another torque value that is lower than a current operating torque of the motor 132). In accordance with the torque setting being set to the reduced torque value, the VFD 134 may control the motor 132 by adjusting (e.g., reducing) the speed of the motor 132 to reduce the torque of the motor 132 to the reduced torque value. In other words, the controller 130 may cause reduction to the torque of the motor 132 by causing the VFD 134 to vary an input frequency and/or an input voltage to the motor 132 to reduce the torque of the motor 132 to the reduced torque value.

In addition to pump-level control of the fluid pump 108, as described herein, the controller 130 (or another controller that controls a fleet of fluid pumps) may also perform system-level control of a plurality of fluid pumps that include the fluid pump 108 (e.g., the fluid system that includes the fluid pump 108 and at least one additional fluid pump). For example, the controller 130 (or the other controller) may perform a cross-check for the plurality of fluid pumps. Here, the controller 130 (or the other controller) may determine an average intake pressure among the plurality of fluid pumps and/or an average discharge pressure among the plurality of fluid pumps. The controller 130 (or the other controller) may detect whether the intake pressure satisfies (e.g., is equal to or less than) the average intake pressure (e.g., the average intake pressure plus or minus an allowance) and/or the discharge pressure satisfies (e.g., is equal to or greater than) the average discharge pressure (e.g., the average discharge pressure plus or minus an allowance). The controller 130 (or the other controller) may cause reduction of the torque of the motor 132 for the fluid pump 108, as described herein, based on the intake pressure satisfying the average intake pressure and/or the discharge pressure satisfying the average discharge pressure.

The controller 130 may log an indication of a fault condition associated with the fluid pump 108. The fault condition may indicate that an irregularity was detected in connection with the fluid pump 108. Thus, the controller 130 may log the indication of the fault condition based on detecting that the torque corresponds to the maximum torque, the intake pressure satisfies the intake pressure threshold (e.g., for the first threshold time period), the discharge pressure satisfies the discharge pressure threshold (e.g., for the second threshold time period), and/or the flow rate is less than the commanded flow rate. Moreover, the indication of the fault condition may indicate a type of the fault condition. For example, if the intake pressure is less than the threshold intake pressure, then the fault condition may indicate a leak. As another example, if the discharge pressure is greater than the threshold discharge pressure, then the fault condition may indicate a clog.

The controller 130 may transmit a notification indicating a fault condition associated with the fluid pump 108. For example, the controller 130 may transmit the notification based on detecting that the torque corresponds to the maximum torque, the intake pressure satisfies the intake pressure threshold (e.g., for the first threshold time period), the discharge pressure satisfies the discharge pressure threshold (e.g., for the second threshold time period), and/or the flow rate is less than the commanded flow rate. The controller 130 may transmit the notification to an orchestration system associated with the hydraulic fracturing system 100, to the data monitoring system 128, and/or to a device associated with an operator, an owner, and/or a servicer of the pump system 104 or the hydraulic fracturing system 100.

While the description herein is described in terms of controlling ramp up by reducing the torque of a single motor 132, in some implementations, the controller 130 may cause reduction of torques of multiple motors 132 that drive respective fluid pumps 108 (e.g., of respective trailers 106).

As indicated above, FIG. 2 is provided as an example. Other examples may differ from what is described with regard to FIG. 2.

Figure 3:
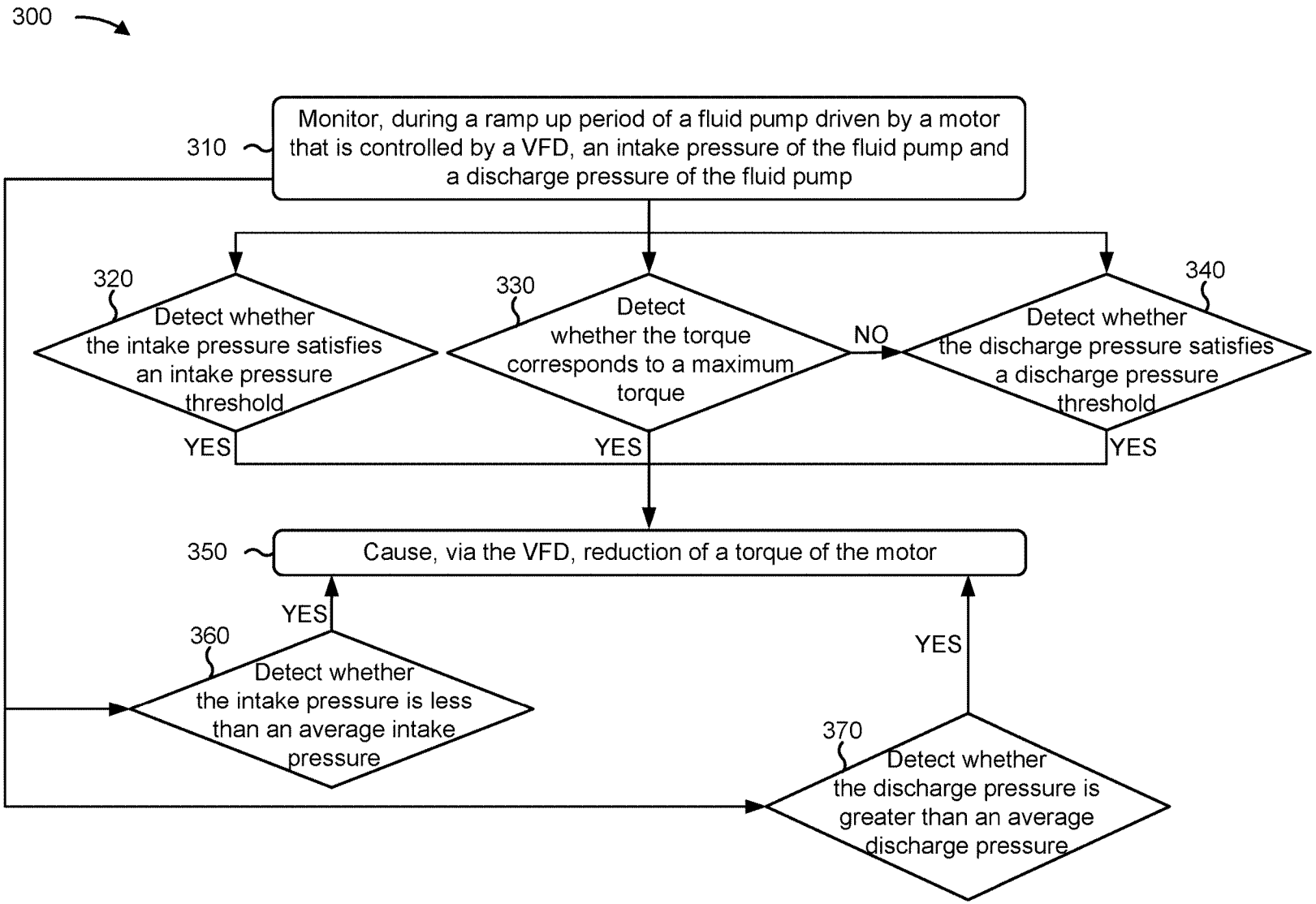
FIG. 3 is a flowchart of an example process relating to controlling ramp up of a fluid pump.

FIG. 3 is a flowchart of an example process 300 associated with controlling ramp up of a fluid pump. One or more process blocks of FIG. 3 may be performed by a controller (e.g., controller 130). Additionally, or alternatively, one or more process blocks of FIG. 3 may be performed by another device or a group of devices separate from or including the controller, such as another device or component that is internal or external to the hydraulic fracturing system 100. Additionally, or alternatively, one or more process blocks of FIG. 3 may be performed by one or more components of a device, such as a processor, a memory, an input component, an output component, and/or communication component.

Process 300 may include monitoring, during a ramp up period of a fluid pump driven by a motor that is controlled by a VFD, an intake pressure of the fluid pump, a discharge pressure of the fluid pump, and a torque of the motor (block 310). For example, the controller (e.g., using a processor, a memory, a communication component, or the like) may monitor, during a ramp up period of the fluid pump, an intake pressure of the fluid pump, a discharge pressure of the fluid pump, and a torque of the motor, as described above.

Process 300 may include detecting, based on monitoring the intake pressure, whether the intake pressure satisfies an intake pressure threshold (block 320). For example, the controller (e.g., using a processor, a memory, or the like) may detect, based on monitoring the intake pressure, whether the intake pressure satisfies an intake pressure threshold, as described above. Process 300 may include detecting, based on monitoring the torque, whether the torque corresponds to a maximum torque (block 330). For example, the controller (e.g., using a processor, a memory, or the like) may detect, based on monitoring the torque, whether the torque corresponds to a maximum torque, as described above. The maximum torque may be based on a setting for a maximum discharge pressure associated with the fluid pump. Process 300 may include obtaining a setting for a maximum discharge pressure, and determining the maximum torque based on the setting for the maximum discharge pressure. Obtaining the setting for the maximum discharge pressure may include receiving an input that indicates the setting for the maximum discharge pressure.

If the torque does not correspond to the maximum torque (block 330—NO), then process 300 may include detecting, based on monitoring the discharge pressure, whether the discharge pressure satisfies a discharge pressure threshold (block 340). For example, the controller (e.g., using a processor, a memory, or the like) may detect, based on monitoring the discharge pressure, whether the discharge pressure satisfies a discharge pressure threshold, as described above.

If the intake pressure satisfies the intake pressure threshold (block 320—YES), the torque corresponds to the maximum torque (block 330—YES), or the discharge pressure satisfies the discharge pressure threshold (block 340—YES), then process 300 may include causing, via the VFD, reduction of the torque of the motor (block 350). For example, the controller (e.g., using a processor, a memory, a communication component, or the like) may cause, via the VFD, reduction of the torque of the motor based on at least one of the intake pressure satisfying the intake pressure threshold, the discharge pressure satisfying the discharge pressure threshold, or the torque corresponding to the maximum torque, as described above. The torque of the motor may be reduced to zero. In some examples, reduction of the torque of the motor may be caused based on at least one of the intake pressure satisfying the intake pressure threshold for a first threshold time period, or the discharge pressure satisfying the discharge pressure threshold for a second threshold time period.

Process 300 may include monitoring, during the ramp up period of the fluid pump, a flow rate associated with the fluid pump, and detecting, based on monitoring the flow rate, whether the flow rate is less than a commanded flow rate (e.g., if the torque does not correspond to the maximum torque). Here, reduction of the torque of the motor may be caused based on the flow rate being less than the commanded flow rate.

Causing reduction of the torque of the motor may include causing, via the VFD, adjustment to a speed of the motor. Moreover, causing reduction of the torque of the motor may include causing the VFD to vary at least one of an input frequency or an input voltage to the motor. For example, causing reduction of the torque of the motor may include setting a torque setting in a control mode for the VFD to a reduced torque value.

Process 300 may include transmitting a notification indicating a fault condition associated with the fluid pump based on the at least one of the intake pressure satisfying the intake pressure threshold, the discharge pressure satisfying the discharge pressure threshold, or the torque corresponding to the maximum torque.

Process 300 may include detecting whether the intake pressure is less than an average intake pressure among a plurality of fluid pumps (block 360). For example, the controller (e.g., using a processor, a memory, or the like), or another controller (e.g., that controls a fleet of fluid pumps), may detect whether the intake pressure is less than an average intake pressure among a plurality of fluid pumps, as described above. The plurality of fluid pumps may include the fluid pump. Process 300 may include detecting whether the discharge pressure is greater than an average discharge pressure among the plurality of fluid pumps (block 370). For example, the controller (e.g., using a processor, a memory, or the like), or the other controller, may detect whether the discharge pressure is greater than an average discharge pressure among the plurality of fluid pumps, as described above. If the intake pressure is less than the average intake pressure (block 360—YES) or the discharge pressure is greater than the average discharge pressure (block 370—YES), then process 300 may proceed to causing, via the VFD, reduction of the torque of the motor (block 350).

Although FIG. 3 shows example blocks of process 300, in some implementations, process 300 may include additional blocks, fewer blocks, different blocks, or differently arranged blocks than those depicted in FIG. 3. Additionally, or alternatively, two or more of the blocks of process 300 may be performed in parallel.

INDUSTRIAL APPLICABILITY

The control system described herein may be used with any hydraulic fracturing system that pressurizes hydraulic fracturing fluid using motor-driven pumps. For example, the control system may be used with a hydraulic fracturing system that pressurizes hydraulic fracturing fluid using a pump that is driven by a motor that is controlled by a VFD. The control system is useful for detecting an irregularity of the hydraulic fracturing system during a ramp up of the pump, and for reducing a flow rate of the pump if the irregularity is detected, thereby preventing excessive wear or damage to the pump that may otherwise occur. In particular, the control system may detect the irregularity by comparing measurements of various operating parameters (e.g., torque, intake pressure, discharge pressure, and/or flow rate) to one or more thresholds, and the control system may automatically take corrective action by reducing the flow rate of the pump (e.g., to zero) if the irregularity is detected. Moreover, the control system may reduce the flow rate of the pump by controlling a torque of the motor via the VFD. In this way, the control system may respond to the irregularity with improved speed.

Thus, the control system provides improved control of the pump during ramp up and reduces a likelihood that the pump will operate under abnormal conditions during ramp up. In particular, utilization of the VFD to reduce motor torque in response to detecting an irregularity enables remedial action to be taken with improved speed and precision. Accordingly, the control system may prevent damage to the pump and/or the hydraulic fracturing system as well as improve a useful life of the pump and/or the hydraulic fracturing system.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of"). As used herein, satisfying a threshold may refer to a value being greater than the threshold, more than the threshold, higher than the threshold, greater than or equal to the threshold, less than the threshold, fewer than the threshold, lower than the threshold, less than or equal to the threshold, equal to the threshold, etc., depending on the context.

What is claimed is:

1. A system for hydraulic fracturing, comprising:
- a fluid pump;
- a motor configured to drive the fluid pump;
- a variable frequency drive (VFD) configured to control the motor; and
- a controller configured to:
  - receive an operator input that indicates a setting for a maximum discharge pressure associated with the fluid pump;
  - monitor, during a ramp up period of the fluid pump, an intake pressure of the fluid pump, a discharge pressure of the fluid pump, a torque of the motor, and a flow rate associated with the fluid pump;
  - detect, based on monitoring the discharge pressure and the torque, whether the torque corresponds to a maximum torque that is based on the setting for the maximum discharge pressure associated with the fluid pump that was indicated by the operator input;
  - detect, based on monitoring the flow rate associated with the fluid pump, whether the flow rate is less than a flow rate set point; and
  - cause, via the VFD, reduction of the torque of the motor based on the torque corresponding to the maximum torque and the flow rate being less than the flow rate set point, the flow rate set point being associated with the maximum torque.

2. The system of claim 1, wherein reduction of the torque of the motor is further caused based on at least one of the intake pressure satisfying an intake pressure threshold for a first threshold time period or the discharge pressure satisfying a discharge pressure threshold for a second threshold time period.

3. The system of claim 1, wherein the controller is further configured to:
- transmit a notification indicating a fault condition associated with the fluid pump based on the torque corresponding to the maximum torque.

4. The system of claim 1, wherein the controller, to cause reduction of the torque of the motor, is configured to:
- cause, via the VFD, adjustment to a speed of the motor.

5. The system of claim 1, wherein the controller, to cause reduction of the torque of the motor, is configured to:
- set a torque setting in a control mode for the VFD to a reduced torque value.

6. The system of claim 1, wherein at least the fluid pump and the motor are mounted on a hydraulic fracturing trailer.

7. The system of claim 1, wherein the intake pressure of the fluid pump is a suction pressure of the fluid pump.

8. The system of claim 1, wherein the controller is further configured to:

determine the maximum torque for the motor, that achieves the maximum discharge pressure, based on a configuration, of a pump system that includes the fluid pump or the system for hydraulic fracturing, and using a look-up table, a torque curve, a physics-based estimation model, or an artificial intelligence model.

9. The system of claim 1, wherein the flow rate set point is a first flow rate set point that is set when the torque corresponds to the maximum torque, the controller being further configured to set the flow rate set point to a second flow rate set point when the torque does not correspond to the maximum torque.

10. A method, comprising:

receiving an operator input that indicates a setting for a maximum discharge pressure associated with a fluid pump driven by a motor that is controlled by a variable frequency drive (VFD);

monitoring a torque of the motor during a ramp up period of the fluid pump during which a flow rate of the fluid pump increases, the ramp up period ending when the fluid pump reaches a commanded flow rate, a target flow rate, or a maximum flow rate;

detecting, based on monitoring the torque of the motor, whether the torque corresponds to a maximum torque that is based on the setting, for the maximum discharge pressure associated with the fluid pump for the ramp up period, indicated by the operator input; and causing, via the VFD, reduction of the torque of the motor based on the torque corresponding to the maximum torque.

11. The method of claim 10, wherein the torque of the motor is reduced to zero.

12. The method of claim 10, wherein causing reduction of the torque of the motor comprises:

causing the VFD to vary at least one of an input frequency or an input voltage to the motor.

13. The method of claim 10, wherein reduction of the torque of the motor is further caused based on at least one of an intake pressure of the fluid pump satisfying an intake pressure threshold for a first threshold time period or a discharge pressure of the fluid pump satisfying a discharge pressure threshold for a second threshold time period.

14. The method of claim 10, further comprising:

transmitting a notification indicating a fault condition associated with the fluid pump based on the torque corresponding to the maximum torque.

15. The method of claim 10, wherein the fluid pump is a hydraulic fracturing pump.

16. The method of claim 10, further comprising:

monitoring a flow rate associated with the fluid pump;

detecting, based on monitoring the flow rate associated with the fluid pump, whether the flow rate is less than a flow rate set point; and causing, via the VFD, reduction of the torque of the motor based on the torque corresponding to the maximum torque and the flow rate being less than the flow rate set point, the flow rate set point being associated with the maximum torque.

17. A controller, comprising:

one or more memories; and one or more processors configured to:

obtain a setting, for a maximum discharge pressure associated with a fluid pump driven by a motor that is controlled by a variable frequency drive (VFD), that is based on an input;

detect, during a ramp up period of the fluid pump, that a torque of the motor corresponds to a maximum torque that is based on the setting for the maximum discharge pressure associated with the fluid pump and based on a configuration that includes one or more of a gear ratio of one or more of the fluid pump or the motor, a stroke length of the fluid pump, a bore diameter of the fluid pump, or a parasitic loss associated with the fluid pump; and cause, via the VFD, reduction of the torque of the motor based on the torque of the motor corresponding to the maximum torque.

18. The controller of claim 17, wherein the one or more processors are further configured to:

determine the maximum torque based on the setting for the maximum discharge pressure.

19. The controller of claim 17, wherein the one or more processors, to cause reduction of the torque, are configured to:

cause reduction of the torque based on the torque of the motor corresponding to the maximum torque and based on one of:

an intake pressure of the fluid pump being less than an average intake pressure among a plurality of fluid pumps that include the fluid pump, or a discharge pressure of the fluid pump being greater than an average discharge pressure among the plurality of fluid pumps.

20. The controller of claim 17, wherein the controller is further configured to:

monitor a flow rate associated with the fluid pump;

detect, based on monitoring the flow rate associated with the fluid pump, whether the flow rate is less than a flow rate set point; and cause, via the VFD, reduction of the torque of the motor based on the torque corresponding to the maximum torque and the flow rate being less than the flow rate set point, the flow rate set point being associated with the maximum torque.

* * * * *